US010668635B2

(12) United States Patent
Sablatschan

(10) Patent No.: US 10,668,635 B2
(45) Date of Patent: Jun. 2, 2020

(54) BLADE SET MANUFACTURING METHOD, BLADE SET AND HAIR CUTTING APPLIANCE

(71) Applicant: KONINKLIJKE PHILIPS N.V., Eindhoven (NL)

(72) Inventor: Siegfried Sablatschan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/091,752

(22) PCT Filed: Apr. 5, 2017

(86) PCT No.: PCT/EP2017/058155

§ 371 (c)(1),
(2) Date: Oct. 5, 2018

(87) PCT Pub. No.: WO2017/174679

PCT Pub. Date: Oct. 12, 2017

(65) Prior Publication Data

US 2019/0152076 A1 May 23, 2019

(30) Foreign Application Priority Data

Apr. 6, 2016 (EP) ..... 16163981

(51) Int. Cl.
*B26B 19/38* (2006.01)
*B26B 19/04* (2006.01)

(52) U.S. Cl.
CPC ..... *B26B 19/3846* (2013.01); *B26B 19/3893* (2013.01); *B26B 19/048* (2013.01)

(58) Field of Classification Search
CPC ..... B26B 19/3846; B26B 19/048; B26B 19/3893
See application file for complete search history.

(56) References Cited

U.S. PATENT DOCUMENTS 1,774,046 A 8/1930 Wahl
1,861,616 A * 6/1932 Wahl ..... B26B 19/06 30/201
2,096,477 A 10/1937 Andis
2,178,669 A 11/1939 Longheed
(Continued)

FOREIGN PATENT DOCUMENTS

DE 355010 C 6/1922
JP 583414 Y 1/1983
(Continued)

*Primary Examiner* — Hwei-Siu C Payer

(57) ABSTRACT

A stationary blade for a hair cutting appliance and a method of forming the stationary blade includes providing tooth components obtained from metal material, where the tooth components are arranged in a substantially flat fashion and are at least partially tapered towards a tip end. The method further includes arranging the tooth components next to each other to form a series of spaced apart teeth, where neighboring tooth components are arranged at a distance from one another; providing a blade base acting as a support receptacle, arranged to receive the tooth components; and interconnecting the tooth components and the blade base in a direct or mediate fashion, thereby forming teeth of the stationary blade.

20 Claims, 7 Drawing Sheets

(56) References Cited

U.S. PATENT DOCUMENTS

| | | | | | |
|---|---|---|---|---|---|
| 2,210,466 | A | | 8/1940 | Beckham | |
| 2,916,820 | A | * | 12/1959 | Clark | B26B 19/20 30/201 |
| 3,093,901 | A | * | 6/1963 | Wahl | B26B 19/205 30/201 |
| 3,279,061 | A | | 10/1966 | Andis | |
| 3,430,342 | A | * | 3/1969 | Wahl | B26B 19/205 30/201 |
| 3,648,370 | A | | 3/1972 | Cercone | |
| 3,844,036 | A | | 10/1974 | Wahl | |
| 4,532,707 | A | * | 8/1985 | Allen | B26B 19/24 30/200 |
| 6,742,262 | B2 | * | 6/2004 | Rizzuto, Jr. | B26B 19/205 30/201 |
| 8,713,802 | B2 | | 5/2014 | Fukutani | |
| 2008/0289192 | A1 | | 11/2008 | Martelli | |
| 2012/0272532 | A1 | | 11/2012 | Sobagaki | |
| 2016/0271814 | A1 | | 9/2016 | Bennik | |
| 2019/0091883 | A1 | * | 3/2019 | Hoexum | B26B 19/06 |
| 2019/0152076 | A1 | * | 5/2019 | Sablatschan | B26B 19/3846 |

FOREIGN PATENT DOCUMENTS

| | | | |
|---|---|---|---|
| JP | 59013962 | Y | 4/1984 |
| KR | 20120051161 | A | 5/2012 |
| KR | 20120121348 | A | 11/2012 |
| WO | 0048795 | A1 | 8/2000 |

* cited by examiner

BLADE SET MANUFACTURING METHOD, BLADE SET AND HAIR CUTTING APPLIANCE

This application is the U.S. National Phase application under 35 U.S.C. § 371 of International Application No. PCT/EP2017/058155, filed on Apr. 5, 2017, which claims the benefit of European Application No. EPO 16163981.0 filed on Apr. 6, 2016. These applications are hereby incorporated by reference herein.

FIELD OF THE INVENTION

The present disclosure relates to a method of forming a stationary blade for a blade set of a hair cutting appliance, to a stationary blade, and to a hair cutting appliance implementing a blade set involving such a stationary blade.

More particularly, the present disclosure relates to improvements in hair cutting devices wherein the cutting action is effectuated by reciprocating blades, such as clippers and trimmers. More specifically, the present disclosure relates to novel approaches to the design and production of stationary blades for blade sets that provide a considerably large length adjustment range. Hence, in at least some embodiments, the present disclosure relates to improvements in length adjustment mechanisms for hair cutting appliances.

BACKGROUND OF THE INVENTION

Hair cutting appliances, particularly electric hair cutting appliances, are generally known and may include trimmers, clippers and shavers, for instance. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to shave or trim (human) body hair, in particular facial hair and head hair to allow a person to have a well-groomed appearance. Frequently, electric hair cutting appliances are used for cutting animal hair.

Typically, a blade set of a hair cutting appliance within the context of the present disclosure comprises a blade set arrangement involving a movable cutter blade (also referred to as cutter or cutter blade) and a stationary blade (also referred to as guard). A relative movement, particularly a relative reciprocating movement, between the stationary blade and the cutting blade causes the cutting action.

Typically, the stationary blade is the blade that is closer to the to-be-treated skin/scalp or hair portion than the cutter blade. Frequently, the stationary blade directly contacts the skin or scalp of the person (or animal) whose hair is to be cut. The stationary blade protects the skin against the fast-moving or fast-reciprocating cutter blade. Both the stationary blade and the cutter blade are provided with teeth comprising cutting edges which cooperate to cut hair in a scissor-like action.

U.S. Pat. No. 2,178,669 A discloses a hair clipper comprising having a stationary cutter-head element built up of laminae or plates. Laminae having extended tooth portions are alternated by laminae lacking extended tooth portions.

U.S. Pat. No. 2,096,477 A discloses a hair clipper shearing comb comprising a stack of similar blanks which define both the teeth and the hair receiving spaces between them.

U.S. Pat. No. 6,742,262 B2 discloses a hair clipper comprising a body with a tongue structure pivotally mounted to and supported by said body; a blade assembly detachably securable to said body and having at least a stationary blade and a reciprocating blade, each blade having a cutting edge; an actuator; and a control lever operatively connected to said actuator, wherein when said control lever is rotated, said actuator causes said cutting edge of said reciprocating blade to move relative to said cutting edge of said stationary blade so as to allow the hair cutting length to be adjusted, wherein said blade assembly has a pocket structure with a bracket for selectively and detachably engaging said tongue structure and thereby enabling said blade assembly to be detachably secured to said body.

As a result of this design, a relative position between tips of the movable blade and the stationary blade can be adjusted. This involves an adjustment of the cutting length, provided that the stationary blade is tapered towards the tip. The cutting length is defined by a present distance or spacing between the actually processed scalp or skin and the cutter blade, particularly a plane in which the cutting edges are arranged.

Generally, blade sets involving a stationary blade that cooperates with a movable blade to effect the hair cutting action are made from steel material which also involves that the stationary blades may be integrally shaped parts. In conventional appliances, as disclosed in U.S. Pat. No. 6,742,262 B2, only a slight tapering of the stationary blade, particularly of the teeth thereof, is present. This enables some fine adjustment of the cutting length. A maximum cutting length provided by these conventional blade sets is typically less than 2.0 mm (millimeter).

So as to expand the length adjustment range, so-called attachment combs may be provided which are typically made from plastic material. The attachment combs are placed on top of the stationary blade so as to increase the distance between the skin/scalp and the blade set. Hence, the plastic attachment combs are additional attachment parts that are generally arranged in a detachable fashion. The attachment combs are not involved in the scissor-like cutting action.

As attachment combs are typically detachable, there is a certain losing risk. Further, even though attachment combs are relatively simple parts, there are certain manufacturing costs, assembly costs and logistic expenses as additional separate parts are involved. Further, operating the attachment combs is sometimes experienced as being uncomfortable, cumbersome, and somewhat outmoded.

There is thus still room for improvement in the design of and manufacturing approaches for stationary blades of hair cutting appliances.

SUMMARY OF THE INVENTION

It is an object of the present disclosure to provide a method of forming a stationary blade for a hair cutting appliance that tackles at least some of the above discussed issues and that preferably allows for adjustable blade sets that enable significantly enlarged length adjustment ranges which preferably results in an improved operational performance and an enlarged field of application of a respectively equipped hair cutting appliance.

Further, it is desirable to present a stationary blade manufacturing method which enables a further reduction of the number of accessory parts of a hair cutting appliance.

Furthermore, it is desirable to provide a corresponding stationary blade, a blade set and a hair cutting appliance comprising a respective blade set involving such a stationary blade.

In a first aspect of the present disclosure there is presented a method of forming a stationary blade for a hair cutting appliance, the method comprising the following steps:

providing a plurality of tooth components obtained from metal material, the tooth components being arranged in a substantially flat fashion and at least partially tapered towards a tip end thereof, arranging the tooth components to form a series of tooth components including teeth, wherein neighboring tooth components are arranged at an offset from one another, providing a blade base arranged to receive the tooth components, and interconnecting the tooth components and the blade base in a direct or mediate fashion, thereby forming a plurality of teeth of the stationary blade.

This aspect is based on the insight that the freedom of design for the stationary blade may be significantly improved by arranging the stationary blade as an assembled blade. When manufacturing conventional blade sets, flat metal material or metal blanks is/are used the height of which defines the overall height of the blade. Hence, the height of an involved pre-product component delimits the height on the stationary blade and, as a result, an achievable length adjustment range. As a result, a respectively equipped hair cutting appliance does not necessarily require an attachment comb to provide the desired length setting range. Operating the hair cutting appliance is facilitated when no additional comb has to be attached.

In accordance with the above aspect, the stationary bladed comprises a metal toothing which involves that the teeth may play an active role in the hair cutting operation, by cooperating with opposite teeth of a movable cutter blade.

Further, in accordance with the above aspect, the height (thickness) of any involved intermediate or pre-product component does not delimit the height (thickness) of the stationary blade, particularly the height of the teeth thereof. This enables a significantly increased tapering of the teeth and results in a considerably increased length adjustment range.

In other words, the orientation of any involved flat material may be rotated by 90° (degrees) when each tooth is made from a respective layer. Hence, a height to length ratio of the teeth may be significantly increased which enables a considerable tapering.

The toothing of the stationary blade may be formed by a series of spaced apart flat single teeth. Hence, the stationary blade may be arranged as a composite stationary blade involving a stacked arrangement of teeth. Further, a cutting width of a blade set involving the stationary blade may be freely selected as the series of teeth is scalable. Generally, each single tooth component forms a single tooth of the series of teeth of the stationary blade.

The stationary blade forming method may be also referred to as stationary blade manufacturing method. Preferably, the teeth of the stationary blade do not require additional processing steps, subsequent to the interconnecting step. Rather, in at least some embodiments, at least operating portions, particularly cutting edges, of the tooth components may be finished before the interconnecting step.

Generally, the blade base may be referred to as blade frame. The blade base is arranged as a supporting receptacle that receives the series of teeth formed by the tooth components. To this end, the blade base may provide respective mounting features. Further, the blade base may provide mounting features for mounting the stationary blade to the appliance, particularly to a cutting length adjustment mechanism thereof, if any.

The step of providing the blade base may involve, in some embodiments, forming the blade base, for instance by injection molding. The injection molding step may form part of the manufacturing process and may be also interrelated with the interconnecting step. This may be the case when the series of tooth components is interconnected by overmolding or insert molding, wherein, at the same time, the blade base is formed by injection molding.

However, the step of providing the blade base may also involve providing a metal blade base which may be referred to, in some embodiments, as blade frame. Hence, the blade base is formed in a preceding step. An already formed blade base may be adequately suited for receiving and supporting the teeth of the stationary blade. However, given the general arrangement of the stationary blade in accordance with the above aspect, the blade base does not have to be made from a material that is suitable for forming cutting teeth comprising cutting edges. In other words, the tooth components that form the teeth may be grinded, hardened and/or comprise a surface treatment so as to improve the cutting performance of the blade set. The blade base basically does not need a respective processing or treatment. Hence, the blade base may be made from a lower-quality material than the tooth components.

The step of interconnecting the tooth components and the blade base may be a multi-stage step involving a plurality of sub steps. For instance, the tooth components may be attached together and subsequently fixed to the blade base. To this end, several options may be envisaged. For instance, attaching the tooth components to the blade base may involve an overmolding procedure, an insert molding procedures, a snap-on locking or a push-fit locking procedure, a bonding procedure involving welding, particularly laser welding, and combinations thereof. In the assembled interconnected state, the tooth components are stacked and form part of a layered stack of teeth and tooth gaps therebetween.

The tooth components are provided in a basically flat form and preferably obtained from flat material, such as sheet metal material. Needless to say, the tooth components may be processed so as to define the cutting edges of the teeth of the stationary blade. Generally, the tooth components form layers or lamellas of the stack that eventually define the teeth of the stationary blade that alternate with tooth gaps.

Generally, the series of tooth components may be arranged in a linear fashion. However, also a curved outline may be envisaged, according to the specific application required. Generally, some embodiments may involve circular blade set arrangements comprising radially protruding teeth. Also for these arrangements, a stacked structure of the toothing may be envisaged.

The stationary blade may be also referred to as guard blade of a blade set for a hair cutting appliance. Preferably, the appliance comprises a cutting length adjustment mechanism that enables a defined relative positioning of the stationary blade and the cutter blade at a selected offset (generally a parallel offset) between involved leading edges of the stationary blade and the cutter blade.

In an exemplary embodiment of the method, the step of interconnecting the tooth components and the blade base comprises the following steps:

stacking the tooth components, thereby forming an intermediate stack, and attaching the intermediate stack to the blade base.

The formed stack and the blade base may comprise respective mounting features that facilitate the mounting process. Mounting features may be present at a rear end of the intermediate stack and at an opposing front surface of the blade base. The mounting features may involve a recess and a corresponding protrusion that define a mounting positon of the intermediate stack at the blade base.

Further, at least in some exemplary embodiments, the blade base comprises a central or main portion and two lateral arms protruding therefrom in a frontal direction, wherein the arms are arranged at a distance and define therebetween a mounting space for the intermediate stack. In other words, the arms of the blade base embrace the intermediate stack. Hence, also the arms of the blade base, at inwardly facing sides thereof, and the intermediate stack, at outwardly facing sides thereof, may be provided with mounting features.

In a further exemplary embodiment of the method, the step of providing a plurality of tooth components comprises the following steps:

providing tooth components at an intermediate manufacturing stage that are obtained from sheet metal material, wherein a thickness of the sheet metal material defines a thickness of the teeth of the stationary blade, and processing the tooth components involving forming cutting edges thereon.

The formation or processing of the cutting edges is preferably performed prior to the stacking operation. Preferably, no further cutting edge shaping processing is required once the stack is formed. Tooth components at an intermediate manufacturing stage may be also referred to as intermediate tooth components.

As the thickness of sheet metal material is generally accurately determined within a narrow tolerance range, also the resulting stack may comprise a sufficiently precise width. When the tooth components are obtained from sheet metal material, a large degree of design freedom is provided. For instance, the tooth components may be significantly tapered which results in a considerably large cutting length adjustment range. Further, mounting features may be processed when the tooth components are separated from the sheet metal material. Generally, the tooth components may be formed with high repeatability which results in even and accurately formed teeth.

In an exemplary refinement of the method, the step of providing intermediate tooth components involves obtaining a plurality of intermediate tooth components from a sheet metal blank by cutting. Cutting may involve punching, laser cutting, and water jet cutting, for instance. The sheet metal blank may be provided in the form of a plate, a strip, a strip coil, and such like. Hence, even though each tooth is separately processed, an efficient production is enabled.

In a further exemplary embodiment, the method further comprises:

providing a plurality of tooth spacers, and forming an intermediate stack at least sectionally comprising a series of tooth components alternating with tooth spacers.

In accordance with at least some embodiments, the tooth spacers define the gap or offset between two neighboring teeth. This involves that the alternating tooth components and the tooth spacers directly contact one another. Hence, the stack is arranged as a layered stack the length (width) of which is defined by the number of tooth components and corresponding tooth spacers.

In an exemplary refinement of the method, the tooth spacers are made from at least one of metal material, plastic material, and combinations thereof.

In an exemplary refinement of the method, the tooth spacers and the tooth components, at a rear end of the intermediate stack, define a mating contour for attaching the stack to the blade base. Hence, the tooth spacers are arranged at and fill the gaps between the tooth components in a rear portion thereof.

In a further exemplary refinement of the method, the tooth spacers are obtained from sheet metal material, wherein a height (also referred to as thickness) of the sheet metal material defines a gap between the teeth of the stationary blade.

In a further exemplary refinement of the method, the step of providing the tooth spacers preferably involves obtaining a plurality of tooth spacers from a sheet metal blank by cutting. By selecting the thickness of the blanks for the tooth components and the thickness of the blanks for the tooth spacers, the tooth width and the gap width may be defined.

In a further exemplary refinement of the method, the step of forming the intermediate stack involves forming an interlocked stack wherein at least some layers engage their neighboring layers in the stack.

In accordance with at least some embodiments, forming the interlocked stack involves interlocking the tooth components and the tooth spacers by mutually engaging the part. This may be achieved, for instance, by means of a clinching or press-joining operation. In other words, one part is partially urged into the other one, e.g. by a punching and/or deforming step. For instance, a mating protrusion may be at least partially urged into a mating recess of a neighboring part. Further, a component of the layered stack may comprise a protrusion engaging a first neighboring part and a recess that is engaged by a protrusion of another (opposite) neighboring part. In other words, the material that is displaced so as to form the protrusion leaves a recess which may be engaged by a further protrusion, etc. Therefore, the protrusions and the recesses of the layers of the stack that engage one another may be arranged at a common engagement axis that is parallel to a main extension (width) direction of the stack.

In a further exemplary embodiment, the step of forming the interlocked stack involves a combined clinching and bonding operation. Bonding may involve laser bonding, for instance. Hence, the material deforming/displacing based mating process of the tooth components may be supplemented by a securing bonding operation which involves at least partially softening/melting and bonding involved metal material.

In a further exemplary embodiment of the method, the blade base is substantially made from metal material and particularly involves aluminum or an aluminum containing alloy. As already indicated above, the blade base does not have to provide the same or similar strength and hardness properties as the tooth components. Rather, the blade base may be formed from a material having reduced mechanical properties. For instance, the blade base may be substantially formed by die casting. Preferably, only a few machining operations or even no machining operations at all are required after the casting operation. Hence, the casting operation may be a near-net shape casting or a net shape casting procedure.

In a further exemplary embodiment of the method, the step of interconnecting the tooth components and the blade base involves overmolding or insert molding the tooth components with a plastic component. This may involve providing a mold in which the tooth components may be arranged before a moldable plastic material is injected in the mold.

Overmolding or insert molding may be present on the level of the tooth components. Hence, an injection molded intermediate part involving the tooth components may be attached to the blade base. The injection molded intermediate part may also involve metal tooth spacers, if any. In the alternative, the plastic material may, so to say, replace the metal tooth spacers, thereby defining the gap between the teeth.

Further, in an alternative embodiment, the step of overmolding or insert molding also involves a formation of the blade base as such. Hence, in a further exemplary refinement of the method, the plastic component forms the blade base, wherein the stationary blade is a metal plastic composite blade. In accordance with this embodiment, the blade base is a plastic component.

Further, in yet another exemplary embodiment, the blade base comprises a metal frame which is further processed by overmolding or insert molding, similar to the tooth components. Hence, also the blade base may be arranged as a metal-plastic composite component. The molding operation may form a mechanical link between the metal frame and the toothing.

In an exemplary refinement of the method, the plastic component at least partially fills the gap between neighboring tooth components and preferably bonds the tooth components to the blade base. This may involve that the plastic component at least partially covers the tooth spacers, if any. Hence, the tooth spacers may still define a spacing between the tooth components. In the alternative, the plastic material of the plastic component replaces the tooth spacers. Hence, between neighboring tooth components, substantially only plastic material is present. This may involve that the mold for the insert molding or overmolding procedure defines the setting and arrangement of the spaced-apart tooth components placed therein before injecting the plastic material.

Generally, the tooth components may comprise a basically flat, trapezoid shape involving a substantially tapered front portion that is tapered towards a frontal tip of the tooth.

In a further exemplary embodiment of the method, the tooth components are arranged at an offset and separately attached to the blade base. This may involve separately bonding single tooth components to the blade base at a defined offset from one another. Bonding may involve welding, sport welding or soldering. Hence, also at least a contact portion of the blade base to which the tooth components are attached is preferably made from metal material. In other words, the tooth spacers may be replaced and the offset/spacing between the tooth components may be defined by a relative positioning of the bonded tooth components with respect to the blade base.

In a further aspect of the present disclosure there is presented a stationary blade for a hair cutting appliance, the stationary blade comprising:

a blade base, and a plurality of teeth fixedly attached to the blade base, wherein respective teeth of the plurality of teeth are formed by separate tooth components obtained from metal material, wherein the tooth components are arranged to form a series of teeth, wherein neighboring tooth components are arranged at an offset from one another, and wherein the tooth components are arranged in a substantially flat fashion and at least partially tapered towards a tip end thereof.

In an exemplary embodiment of the stationary blade, the tooth components are stacked, wherein gaps between the tooth components are defined by tooth spacers obtained from metal material.

In another exemplary embodiment of the stationary blade, the tooth components are stacked, wherein gaps between the tooth components are defined by plastic material that fills at least a portion of the gaps and defines the tooth spacers. Also a combination of plastic material and metal material may be envisaged for forming the tooth spacers.

In another exemplary embodiment of the stationary blade, the tooth components and the tooth spacers, if any, are attached to a metal blade base by bonding, particularly welding or laser welding.

In another exemplary embodiment of the stationary blade, the blade base comprises adjustment features for cutting length adjustment. Cutting length adjustment typically involves a relative setting movement between the stationary blade and the cutter blade in a direction that is perpendicular to a main extension direction of the leading edges thereof which are defined by the respective tooth tips thereof. Cutting length adjustment features may involve elongated holes (slots) having an elongation direction that is parallel to the adjustment movement direction.

In a further exemplary embodiment of the stationary blade, the teeth are tapered and provide a length adjustment range of at least 3.0 mm, preferably of at least 5.0 mm, further preferred of at least 10.0 mm, further preferred of at least 15.0 mm. Hence, a single blade set may enable a cutting length adjustment range that can be provided in conventional blade sets only by providing additional attachments combs. This may involve a design of the stationary blade wherein the tooth components that defined the teeth extend upwardly towards to top side beyond an extension of the blade base. Hence, the tooth components may be considerably higher than the blade base.

In a further aspect of the present disclosure there is presented a hair cutting appliance comprising a blade set comprising a stationary blade in accordance with at least one embodiment as disclosed herein. Preferably, a cutting length adjustment mechanism for the blade set is provided. The adjustment mechanism may also adjust and set a tip to tip distance between tip portions of the stationary blade and a movable cutter blade of the blade set. Generally, the appliance may be arranged as a hair clipper and/or a beard trimmer.

In a further aspect of the present disclosure there is presented a hair cutting appliance, particularly a trimmer or clipper, comprising a housing, a cutting head comprising a blade set comprising a stationary blade and a cutter blade, wherein the stationary blade and the cutter blade are arranged to be moved with respect to one another to cut hair, wherein the stationary blade is at least manufactured in accordance with an embodiment of the method as disclosed herein or arranged in accordance with an embodiment of the stationary blade as disclosed herein, and a cutting length adjustment mechanism arranged to set a relative position between teeth of the stationary blade and teeth of the cutter blade so as to define a cutting length.

Preferably, the hair cutting appliance is a hand-held electrically powered hair cutting appliance. Typically, the hair cutting appliance comprises an elongated housing and a cutting head at a top end thereof where the blade set is provided. Typically, the blade set comprises at least one stationary blade and at least one movable cutter blade that is operable to be moved with respect to the stationary blade to cut hair. The elongated housing further comprises a bottom end which is opposite to the top end thereof. Further, a front side and a rear side are provided. When the hair cutting appliance is in operation, typically the top side, where the blade set is arranged, contacts the to-be-groomed skin portion in a direct or mediate (i.e. via an attachment comb) fashion. The front side is typically facing the skin portion, when the appliance is in use. Consequently, the rear side is typically facing away from the skin when the hair cutting appliance is in operation.

Generally, when the hair cutting appliance is in operation, the stationary blade is not moved in a reciprocating fashion with respect to a housing thereof. Rather, the cutter blade is operated and moved with respect to the stationary blade and with respect to the housing in a reciprocating fashion. As a result, a relative movement between the stationary blade and the cutter blade is effectuated for the hair cutting operation.

Preferred embodiments of the disclosure are defined in the dependent claims. It should be understood that the claimed method can have similar preferred embodiments as the claimed blade set assembly and the claimed appliance and as defined in the dependent system/device claims, and vice versa.

BRIEF DESCRIPTION OF THE DRAWINGS

These and other aspects of the disclosure will be apparent from and elucidated with reference to the embodiments described hereinafter. In the following drawings

DETAILED DESCRIPTION OF THE EMBODIMENTS

Figure 1:
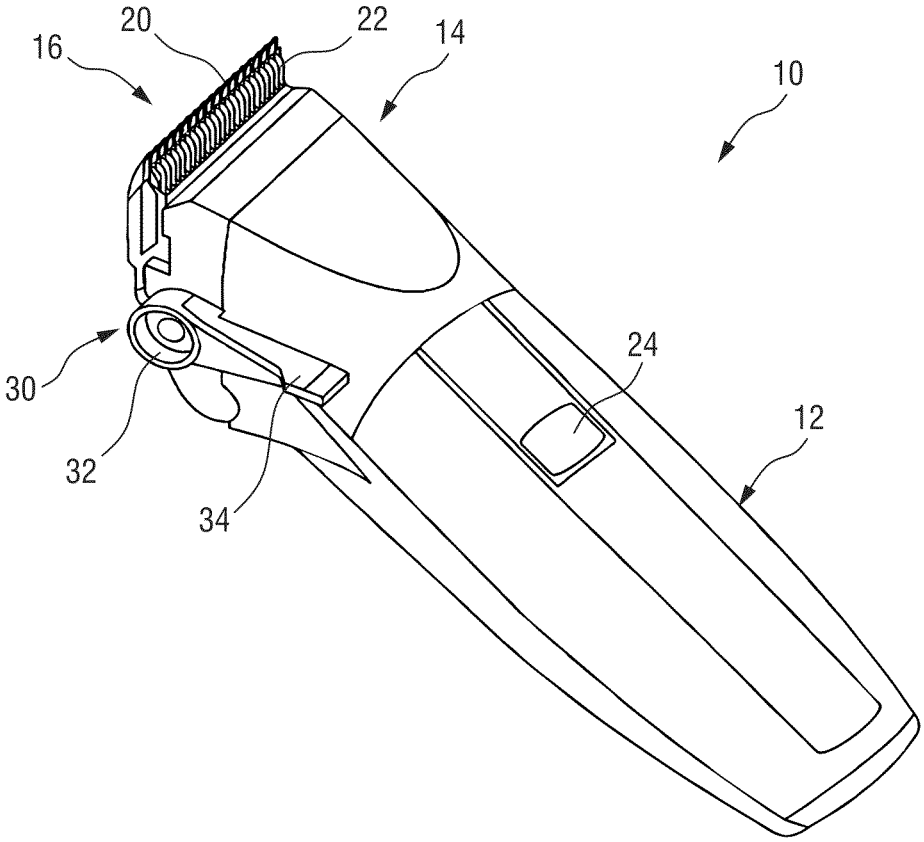
FIG. 1 shows a schematic perspective view of an exemplary embodiment of an electric hair cutting appliance arranged as a hair clipper.

FIG. 1 shows a schematic perspective rear view of a hair cutting appliance 10, particularly an electrically operated hair cutting appliance 10. The appliance 10 may also be referred to as hair clipper or hair trimmer. The appliance 10 comprises a housing or housing portion 12 having a generally elongated shape. At a first, top end thereof, a cutting head 14 is provided. The cutting head 14 comprises a blade set assembly 16. The blade set assembly 16 comprises a stationary blade 20 and a movable cutter blade 22 that may be moved with respect to each other to cut hair. At a central portion and a second, bottom end of the housing 12, a handle or grip portion is formed. A user may grasp or grab the housing 12 at the grip portion.

The appliance 10 in accordance with the exemplary embodiment of FIG. 1 further comprises operator controls. For instance, an on-off switch or button 24 may be provided.

For illustrative purposes, the housing 12 of the hair cutting appliance 10 comprises a top side, where the blade set 16 is mounted, a bottom side that is opposite to the top side, a front side which typically faces the skin of the to-be-groomed subject when the appliance 10 is in operation, and a rear side that is opposite to the front side. These and other positional and/or directional indications shall not be construed as limiting the scope of the disclosure.

Hair cutting appliances are known that implement an adjustment mechanism 30 for the blade set. The adjustment mechanism 30 may be manually operated or motor powered. Generally, the adjustment mechanism 30 may be arranged as a tip to tip adjustment mechanism that sets and adjusts a distance between the tips of the stationary blade 20 and the cutter blade 22. Hence, an offset in the frontal direction between toothed leading edges of the stationary blade 20 and the cutter blade 22 may be adjusted. When the stationary blade 20 is at least partially tapered toward the frontal end, the tip to tip adjustment also involves a cutting length adjustment.

As can be further seen from FIG. 1, the adjustment mechanism 30 comprises an actuator element 32 which is exemplarily arranged as an operator lever 34. The operator lever 34 is operatively coupled with the blade set 16 so as to adjust the relative position between the stationary blade 20 and the cutter blade 22.

Figure 2:
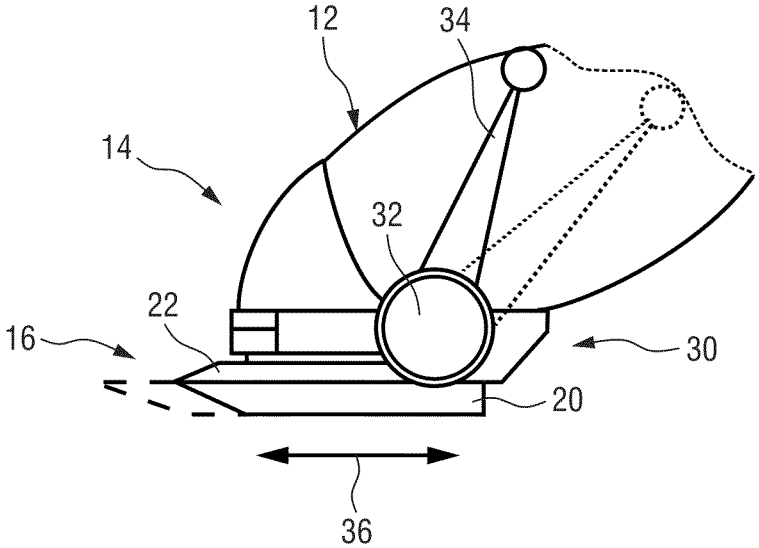
FIG. 2 shows a simplified schematic side view of an exemplary embodiment of a cutting length adjustment mechanism for a hair cutting appliance.

Further reference in this context is made to FIG. 2 schematically illustrating an operation of an adjustment mechanism 30. FIG. 2 shows a simplified view of a cutting head 14 of a hair cutting appliance 10. At or adjacent to the cutting head 14, the appliance 10 is provided with the adjustment mechanism 30 that involves an actuator element 32 which is arranged as an operator lever 34. The operator lever 34 can be moved between a first state and a second state. In FIG. 2, the first state is indicated by continuous lines. The second state is indicated by dashed lines. The first state is associated with a first, retracted state of the stationary blade 20. The second state is associated with a second, extracted state of the stationary blade 20 which is indicated in FIG. 2 by dashed lines. A double arrow designated by reference numeral 36 indicates the adjustment movement between the stationary blade 20 and the cutter blade 22. Hence, a distance between the leading edges of the stationary blade 20 and the cutter blade 22 can be adjusted which involves a cutting length adjustment, as the stationary blade 20 is slightly tapered towards the frontal end.

In conventional hair cutting appliances, cutting length adjustment mechanisms that utilize an adjustment of the stationary blade 20 and the cutter blade 22 of the blade set 16 as such may provide only limited adjustment ranges, as there are design limits for the tapering of unibody or integrally formed stationary blades. Hence, conventional blade cannot provide a large tapering, due to practical limits for the height thereof.

In accordance with at least some embodiments and aspects of the present disclosure, novel approaches to the design and manufacturing of stationary blades for blade sets 16 of hair cutting appliances 10 are presented and will be further described hereinafter.

In this context, reference is made to FIGS. 3 to 11 which illustrate exemplary embodiments of a stationary blade 40. As with the stationary blade 20 of FIG. 1 and FIG. 2, also the stationary blade 40 may be operatively coupled with a cutter blade 22 so as to form a blade set 16. Further, the stationary blade 40 may form part of an adjustable blade set 16 that is arranged to be adjusted by an adjustment mechanism 30 as shown in FIG. 1 and FIG. 2. The stationary blade 40 is particularly suited for blade sets 16 of hair clippers that implement an integrated tip-to-tip or cutting length adjustment.

For illustrative purposes, the stationary blade 40 and the blade set 16 will be described herein with reference to main orientations and directions. It should be understood that the direction and orientation indications shall not be construed as limiting the scope. Rather, the skilled person can readily convert or transfer the indications when being confronted with alternative embodiments, views and orientations.

An end of the blade set 16 to which the tips of the teeth point will be referred to as front side or frontal end. At the frontal end, the teeth of the stationary blade 40 and the movable cutter blade 22 define respective leading edges. An opposite side facing away from the front side will be referred to herein as rear side or rear end.

Further, a side of the blade set which is facing the skin and which comes into contact with the skin will be referred to herein as top side. An opposite side facing away from the top side will be referred to herein as bottom side. At the level of the blade set 16, the stationary blade 40 is arranged at the top side. The movable cutter blade 22 is arranged at the bottom side. The two remaining sides may be referred to as lateral sides.

Again referring the FIGS. 3 to 11, the stationary blade 40 is shown as an assembled blade or layered/laminated blade. As can be readily seen from FIG. 3, the assembled stationary blade 40 may comprise a considerably large tapering towards the frontal end which enables a large cutting length adjustment range as an effective distance between the cutter blade 22 and the currently contacted skin or scalp portion may be adjusted within a wide range.

Figure 3:
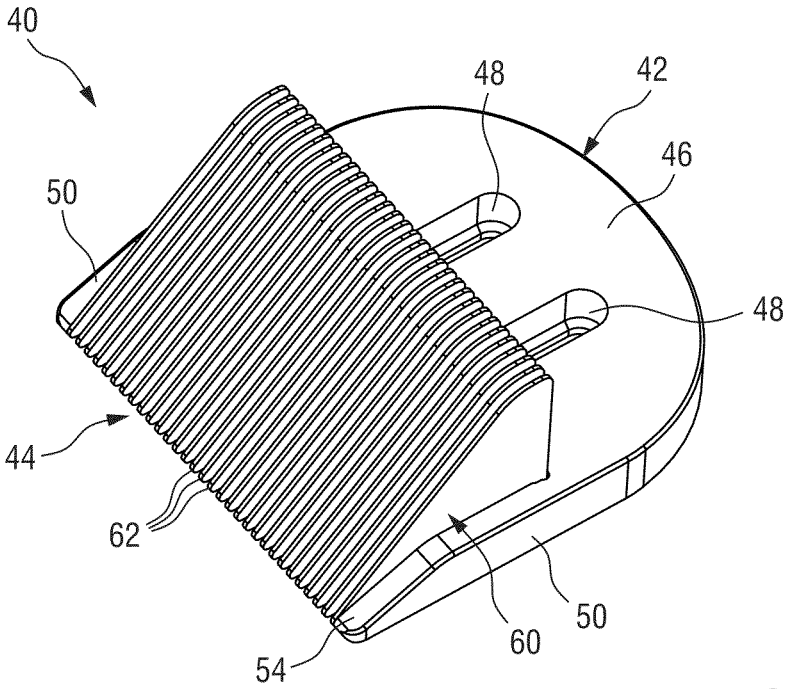
FIG. 3 shows a perspective frontal top view of an exemplary embodiment of a stationary blade for a blade set for a hair cutting appliance.
Figure 4:
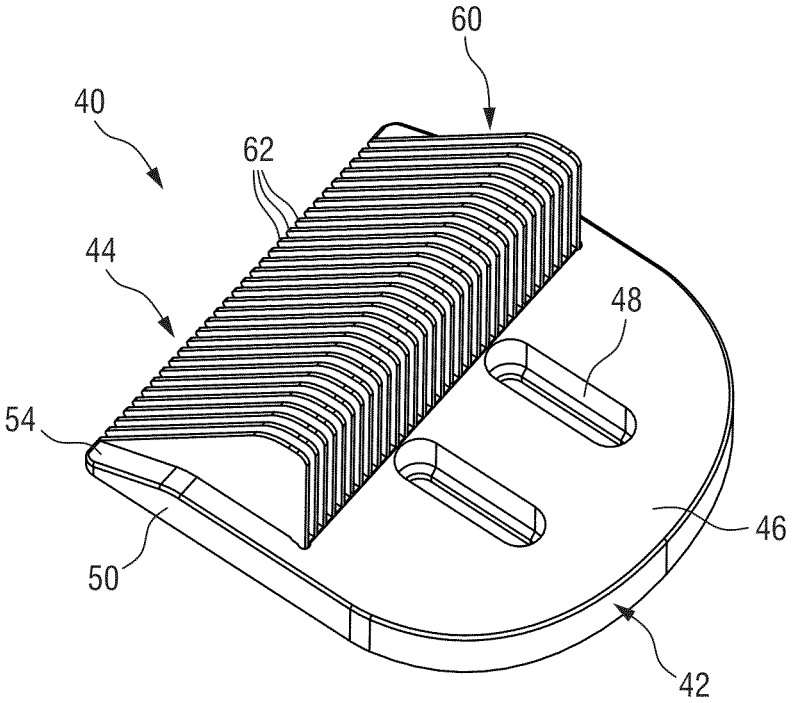
FIG. 4 shows a perspective rear top view of the stationary blade of FIG. 3.
Figure 5:
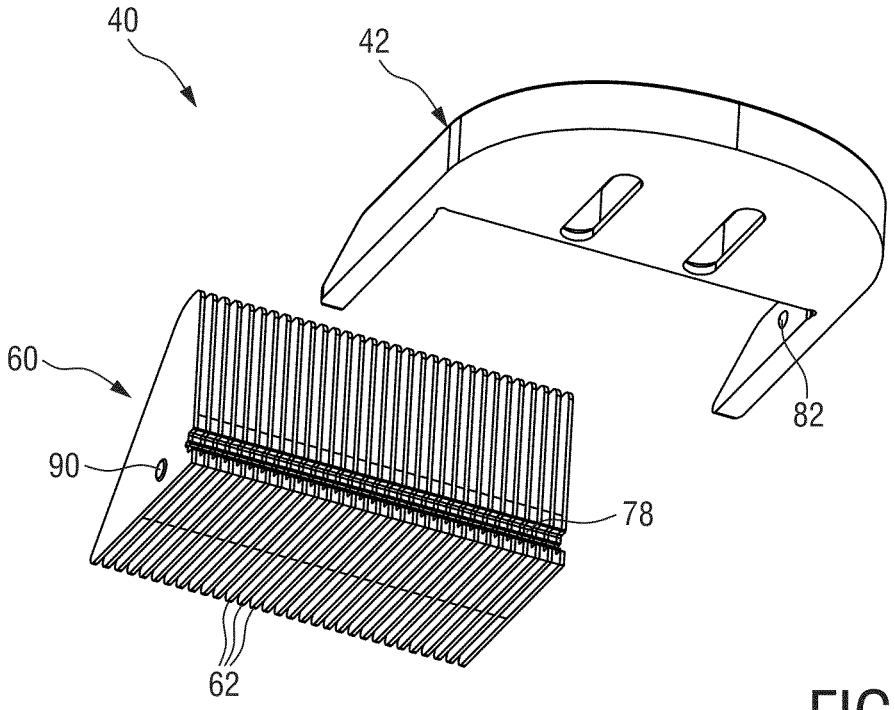
FIG. 5 shows a partially exploded rear bottom view of the stationary blade of FIG. 3.
Figure 6:
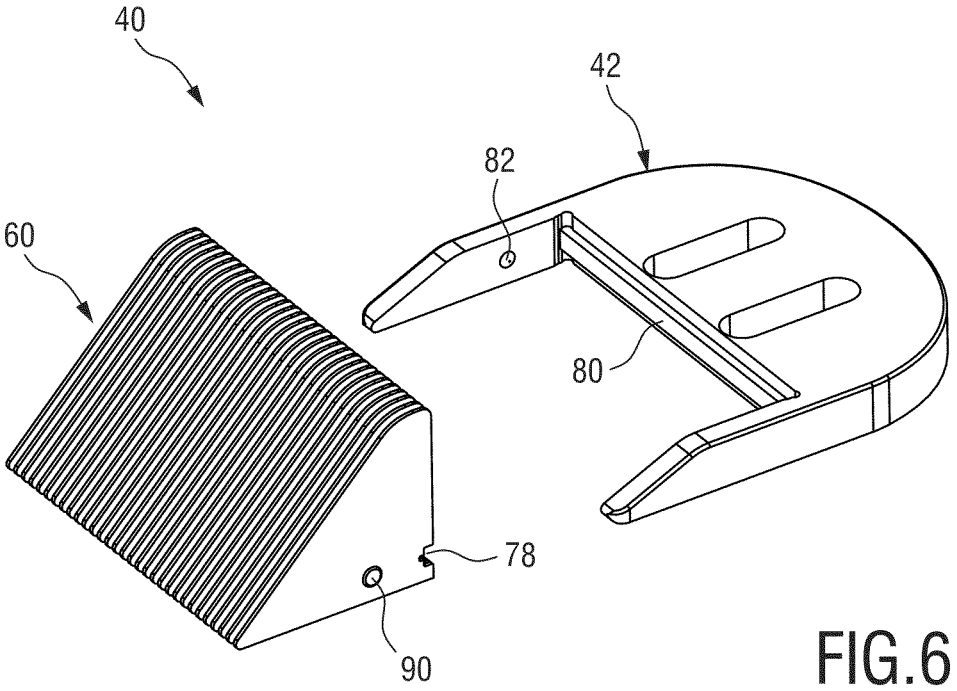
FIG. 6 shows a partially exploded frontal top view of the stationary blade of FIG. 3.

FIG. 3 and FIG. 4 show a frontal top view and a rear top view of the stationary blade 40. The stationary blade 40 comprises a blade base 42 that is arranged in a basically flat fashion. The blade base 42 of the exemplarily shown embodiment is arranged as a basically flat plate. Further, the stationary blade 40 comprises a toothing 44 which involves a toothed leading edge at the frontal end thereof. The stationary blade 40, particularly the toothing 44, comprises a considerable tapering towards the frontal end.

The blade base 42 may be arranged as a metal component. In alternative embodiments, the blade base 42 may be arranged as a plastic component. In alternative embodiments, the blade base 42 may be arranged as a composite metal-plastic component. The blade base 42 comprises a basically flat rear portion 46 in which slots 48 are formed. The slots 48 are arranged as mounting slots which define a certain adjustment movement range and direction of the stationary blade. The slots 48 extend parallel to a direction from the rear end to the frontal end to the stationary blade 40. The slots 48 may be arranged as guides for a relative adjustment movement between the stationary blade 40 and the cutter blade 22. The slots 48 are basically parallel to the adjustment movement direction (reference numeral 36 in FIG. 2).

The blade base 42 further comprises two lateral arms 50 arranged at opposite (lateral) sides of the stationary blade 40. The lateral arms 50 define therebetween a receiving space for the toothing 44. The lateral arms 50 further comprise a tip region at a frontal end thereof. The rear portion 46 and the lateral arms 50 may define a basically U-shaped overall shape of the blade base 42. The blade base 42 may be also referred to as blade frame.

The toothing 44 is formed by a stack 60. The toothing comprises a series or row of teeth 62 that are spaced from one another. Between the teeth 62, tooth spaces or gaps are provided. As can be best seen from the partially exploded views of FIG. 5 and FIG. 6, the stack 60 may be attached to the blade base 42, thereby forming the stationary blade 40.

Figure 7:
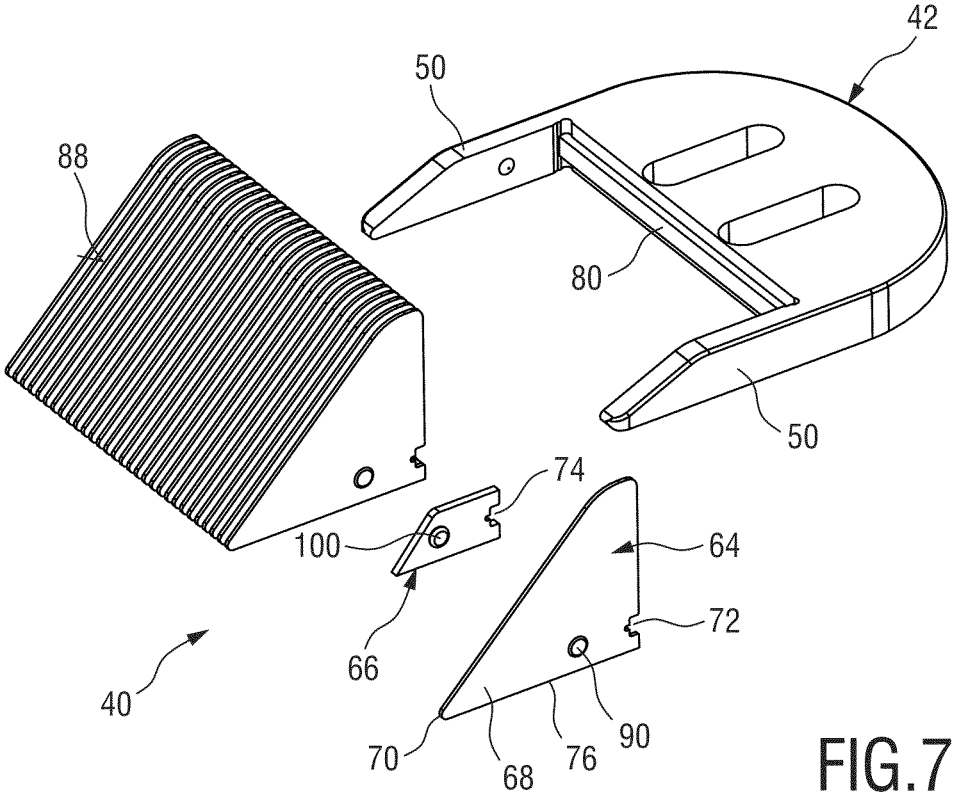
FIG. 7 shows a further view of the stationary blade of FIG. 3 in accordance with the arrangement and orientation of FIG. 6, wherein further a tooth component and a tooth spacer are shown in an exploded state.
Figure 10:
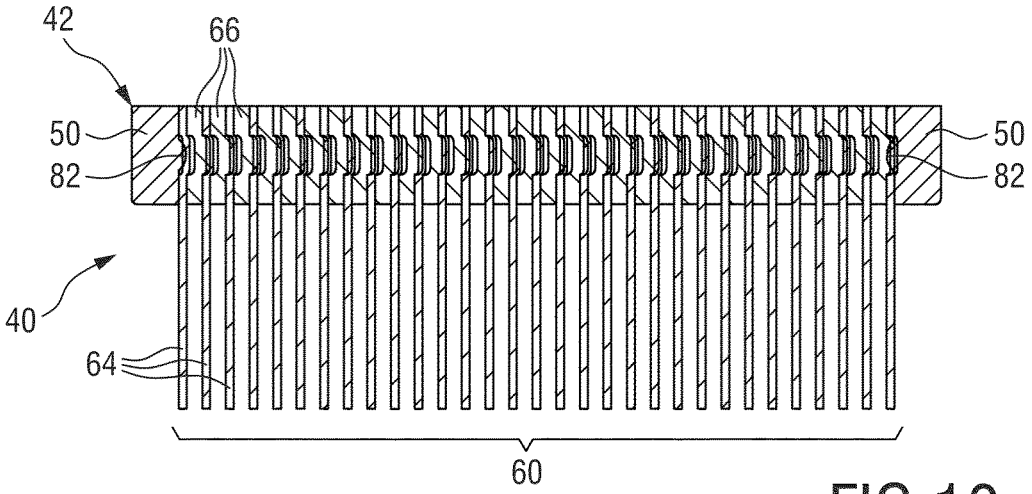
FIG. 10 shows a cross-sectional view of the arrangement of FIG. 3 along the line X-X in FIG. 9.
Figure 11:
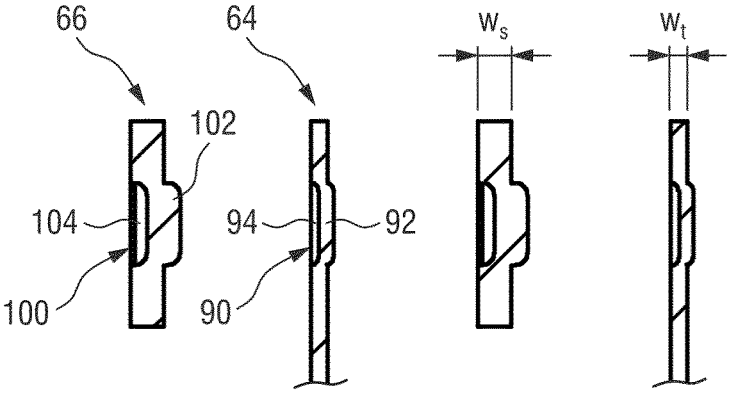
FIG. 11 shows a partial cross-sectional view of tooth components and tooth spacers in accordance with the arrangement of FIG. 10, the tooth components and tooth spacers shown in an exploded state.

The teeth 62 of the toothing 44 are formed by separate and space-apart tooth components 64, refer also to FIG. 7, FIG. 10 and FIG. 11. The tooth components 64 are arranged in series, i.e., to form a series of tooth components including teeth, and at a defined offset therebetween. The offset between neighboring tooth components 64 in the stack 60 that forms the toothing 44 may be referred to as tooth gap.

In some embodiments, the spacing between the tooth components 64 in the stack 60 is defined by tooth spacers 66. Hence, an alternating series of tooth components 64 and tooth spacers 66 may form the stack 60. The tooth components 64 may be also referred to as tooth lamellas. The tooth spacers 66 may be also referred to as spacing lamellas.

In at least some embodiments, the tooth components 64 may be obtained from basically flat metal material, particularly from sheet metal material. Similarly, also the tooth spacers 66 may be obtained from basically flat metal material, particularly from sheet metal material.

A main planar extension of the tooth components 64 is basically perpendicular to a main planar extension of the blade base 42. Hence, by switching the orientation of the pre-product material for the tooth components 64, freedom of design for the teeth 62 may be significantly increased.

Figure 8:
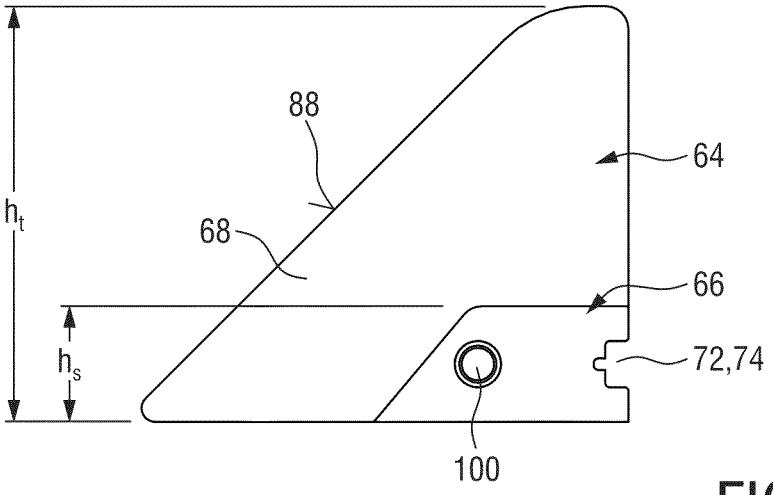
FIG. 8 shows a side view of a tooth component and a tooth spacer for a stationary blade as shown in FIG. 3 to FIG. 7.
Figure 9:
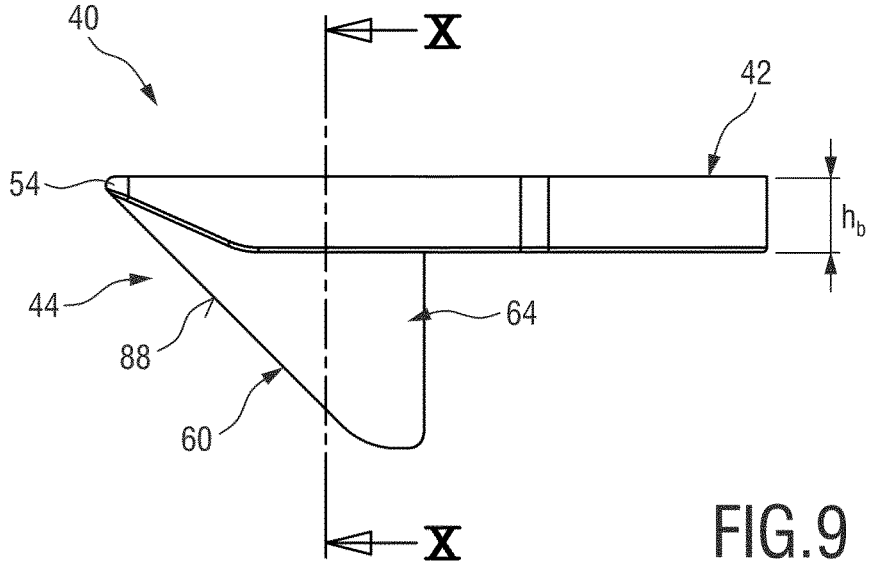
FIG. 9 shows a side view of the stationary blade of FIG. 3.

Reference is made in this context to FIG. 8. Additional reference is made to FIG. 9. FIG. 8 is a side view of an exemplary tooth component 64 and a tooth spacer 66. The larger tooth component 64 is arranged behind the smaller tooth spacer 66. A height of the tooth component 64 is indicated by $h_t$. A height of the tooth spacer 66 is indicated by $h_s$. In FIG. 9, a height of the blade base 42 is indicated by $h_b$.

It can be clearly seen that the height $h_t$ of the tooth component 64 and, as a result, the height to the teeth 62 may be significantly larger than the height $h_b$ of the blade base 42. The height $h_s$ of the tooth spacer 66 may basically correspond to the height $h_b$ of the blade base 42, depending on the circumstances.

If the stationary blade 42 was arranged as a conventional unibody, integrally shaped component, a lot of machining would be required so as to form a similar arrangement, starting from a pre-product workpiece having a basically constant height. Therefore, in practice, the height $h_t$ of the tooth component 64 would basically correspond to the (much smaller) height $h_b$ of the blade base 42 in conventional stationary blade (refer to the stationary blade 20 shown in FIG. 2).

In accordance with the present disclosure, the assembled stationary blade 40 implementing a layered stack 60 allows for a much greater adjustment range. The enabled height $h_t$ of the tooth components 64 allows for a considerably large tapering 68 of the tooth components 64. This has the effect that a large adjustment range can be provided. As indicated above, the provided adjustment range may involve at least 0.0 mm to 3.0 mm, preferably at least 0.0 mm to 5.0 mm, further preferred at least 0.0 mm to 10.0 mm, further preferred at least 0.0 mm to 15.0 mm. Needless to say, in practice, a cutting length of 0.0 mm can be hardly realized. Rather, a minimum cutting length is typically slightly above 0.0 mm (>0.0 mm excluding 0.0 mm). The tooth components 64 are tapered at the top side thereof towards their frontal tips 70.

The tooth components 64 may comprise mounting features which involve mounting recesses 72. The tooth spacers 66 may comprise mounting features which involve mounting recesses 74. Further, cutting edges 76 are provided and processed at the tooth spacers 66. The cutting edges 76 are also present at the resulting teeth 62 of the toothing 44 of the stationary blade 40.

In the sub-assembled state of the intermediate stack 60, the mounting features of the involved tooth components 64 are aligned. The same may apply to the mounting features of involved tooth spacers 66, if any. The mounting features form a mating contour 78 of the stack 60 which is adapted to a mating contour 80 of the blade base 42, refer to FIG. 5 and FIG. 6. The mating contours 78, 80 may be referred to as mounting features. In the exemplary embodiment of FIG. 5 and FIG. 6, the mating contour 78 is a mating recess extending basically parallel to a leading edge defined by the tips 70 of the tooth components 64. Further, the mating contour 80 is a mating tab formed by a corresponding frontal protrusion of the blade base 42 that extends between the lateral arms 50. Further, at the lateral arms 50, lateral mounting features 82 may be provided.

As can be best seen from FIG. 7 and FIG. 8, the tapering 68 of the tooth components 64 defines a contact surface 88 of the toothing 44. The contact surface 88 is arranged to contact the to-be-processed skin or scalp portion when the hair cutting appliance 10 is operated. As the stationary blade 40 is preferably movable with respect to the cutter blade 22, also the resulting cutting length is varied, due to the inclined contact surface 88.

Further reference is made to FIG. 9, FIG. 10 and FIG. 11. FIG. 9 is a side view of the stationary blade 40 of FIGS. 3 to 8. FIG. 10 is a corresponding cross-sectional view along the line X-X in FIG. 9. FIG. 11 details the arrangement of FIG. 10 by means of a partial exploded view of components thereof.

In an exemplary embodiment, the intermediate stack 60 resembles, in at least some respect, so-called laminated stator sheets for electric motors. Hence, a plurality of lamellas is provided. The lamellas are embodied by the tooth components 64 and the tooth spacers 66, if any. The lamellas may be also referred to as layers. FIG. 10 illustrates an interconnected state of the tooth components 64 and the tooth spacers 66. The stack 60 is received between the two lateral arms 50 of the blade base 42.

The stack 60 involves an alternating order of tooth components 64 and tooth spacers 66 that define teeth 62 and tooth gaps, respectively. The tooth components 64 and the tooth spacers 66 may be fixedly interconnected by a material displacing operation by which portions of involved parts are urged into neighboring parts. The procedure is similar to a clinching procedure which may be performed at laminated stator sheets for electric motors.

The respective layers are partially deformed, at an engagement spot. This results in a protrusion at one lateral side and a recess at the opposite lateral side. Hence, the protrusion may engage a neighboring recess. Further, the recess may be engaged by a neighboring protrusion. Hence, the desired alignment and relative orientation of the layers of the stack 60 may be ensured.

Further, also the arms 50 of the blade base 42 may be provided with respective lateral mounting features 82 as already discussed above.

At the tooth components 64, engagement features 90 involving engagement protrusions 92 and engagement recesses 94 may be present. At the tooth spacers 66, engagement features 100 involving engagement protrusions 102 and engagement recesses 104 may be present. In the mounted state, the engagement features 90, 100 are aligned and arranged at an axis that is parallel to the leading axis defined by the tips 70 and parallel to the main extension of the mating contours 78, 80. In FIG. 11 a width of the tooth components 64 is indicated by $w_t$. Further, a width of the tooth spacers 64 is indicated by $w_s$. The width $w_s$ may define the offset between neighboring tooth components 64. In combination, the width $w_t$ and the width $w_s$ define a pitch width of the toothing 44. As shown in FIG. 11, the width $w_t$ and the width $w_s$ may be different from one another which further enhances the freedom of design.

In one exemplary embodiment, the interaction of the recesses and the protrusions ensures a desired relative orientation and alignment between the layers of the stack 60. So as to secure the arrangement, a bonding operation may be performed which may involve laser welding or soldering, for instance.

In another exemplary embodiment, the engagement of the recesses and the protrusions ensures already secures the arrangement of the layers of the stack 60. Hence, no additional bonding operation is required. Hybrid forms may be envisaged wherein the both the engagement of the recesses and the protrusions and an additional bonding secure the stack 60.

As already indicated above, the formation of the stationary blade 40 may also involve an insert molding or overmolding procedure. Therefore, the above explained embodiment shall not be construed as limiting the scope. Hence, the stack may be also formed by a molding operation. Further, in the alternative, the stack may be secured by a molding operation. Further, in the alternative, the stack may be composed of basically flat layers that are not provided with engagement protrusions and recesses as discussed above in connection with FIGS. 9 to 11. In this exemplary embodiment, the stack may be primarily and solely secured by a bonding operation involving laser welding, soldering, etc.

Figure 12:
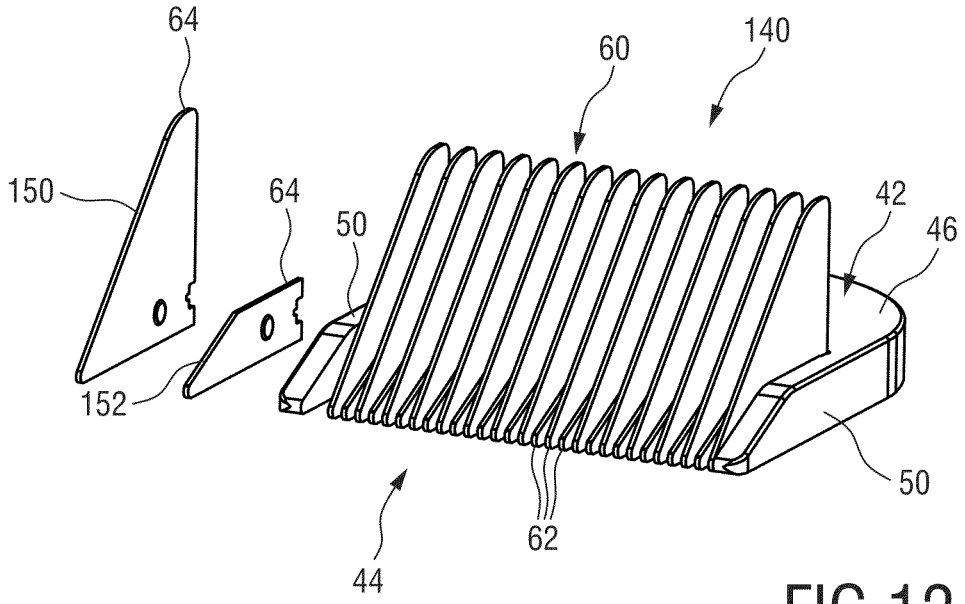
FIG. 12 shows a perspective frontal top view of another exemplary embodiment of a stationary blade for a blade set for a hair cutting appliance, wherein further two differently shaped tooth components are shown in an exploded state.
Figure 13:
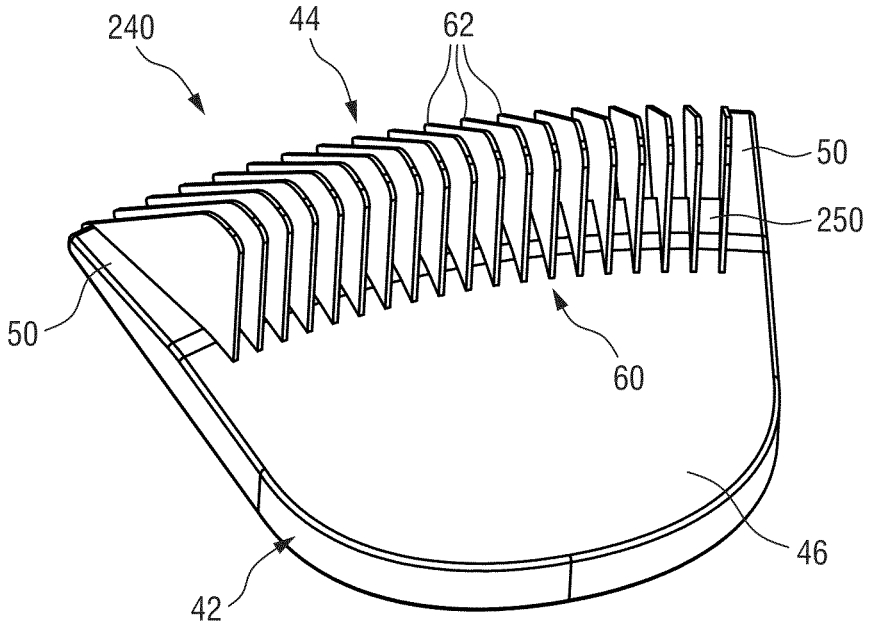
FIG. 13 shows a perspective rear top view of another exemplary embodiment of a stationary blade for a blade set for a hair cutting appliance.

Additional reference is made to FIG. 12 and FIG. 13 illustrating alternative embodiments of stationary blades 140, 240 within the context of the present disclosure. The stationary blades 140, 240 of FIG. 12 and FIG. 13 are considerably similar to the arrangements shown in FIGS. 3 to 11. Hence, primarily alternative and/or additional aspects will be explained in the following.

FIG. 12 shows a stationary blade 140 that comprises a stack 60 of tooth components 64. Further, as already explained above, also tooth spacers 66 may be present (hidden in FIG. 12). The stack 60 involves a series of tooth components 64 that are arranged at an offset. The arrangement of the stationary blade 140 of FIG. 12 differs from the arrangement of FIGS. 3 to 11 in that the tooth components 64 are differently shaped. For instance, a first type 150 and a second type 152 of tooth components 64 may be present. A representative of the first type 150 and a representative of the second type 152 are shown in FIG. 12 in an exploded state. The first type tooth components 150 may involve a greater height than the second type tooth components 152, for instance.

Hence, the series of tooth components 64 that forms part of the stack 60 and that eventually defines the toothing 44 of the stationary blade 140 may involve alternating types of the tooth components 64. A first type tooth component 150 and a second type tooth component 152 may follow one another in the series. Other configurations may be envisaged, for instance two second type tooth components 152 which are followed by a single first type tooth components 150 which is followed by two second type tooth components 152, and so forth.

In accordance with the arrangement of FIG. 12, a hair catching and upright positioning prior to the cutting action may be improved.

FIG. 13 shows a stationary blade 240 that comprises a stack 60 of tooth components 64 that define a toothing 44. In contrast to the linear arrangement of the stationary blades 40, 140 described above, the stationary blade 240 has a somewhat curved outline or leading edge defined by frontal tips of the involved teeth 62 of the toothing 44. The tooth components 64 define an arched leading edge.

Accordingly, also mounting features, mating contours and/or engagement features may be arranged at or may extent along a somewhat curved path in accordance with the curved arrangement of the toothing 44.

Further, in the exemplary embodiment of the stationary blade 240 of FIG. 13, no distinct (metal) tooth spacers are present. Rather, gaps between the tooth components 64 are filled by spacer protrusions 250 of the blade base 42. In accordance with the embodiment of FIG. 13, the blade base 42 may be arranged as an at least partially plastic material part. The blade base 42 may be obtained by a molding procedure, particularly an overmolding or insert molding procedure. Forming the blade base 42 may involve interconnecting the tooth components 64 by insert molding or overmolding. Further, the plastic material may enter the gaps between the tooth components 64 so as to form the spacer protrusions 250. The blade base 42 may be entirely made from plastic material. Further, in alternative embodiments, the blade base 42 may involve a metal core or frame to which plastic material is molded. So as to secure the insert molded or overmolded assembly, the tooth components 64 may be provided with appropriate recesses that can be filled by the plastic material, thereby interconnecting the series of tooth components 64 and firmly attaching the stack 60 to the blade base 42.

Needless to say, also the embodiments of FIG. 12 and FIG. 13 may be combined with any other reasonable embodiment of the stationary blades as discussed herein. This applies in particular to the differently shaped tooth components 64 of FIG. 12, to the arrangement of the blade base 42 as an at least partially plastic part, the curved arrangement of the toothing 42, and to the plastic spacer protrusions 250 of the blade base 42 of FIG. 13.

Figure 14:
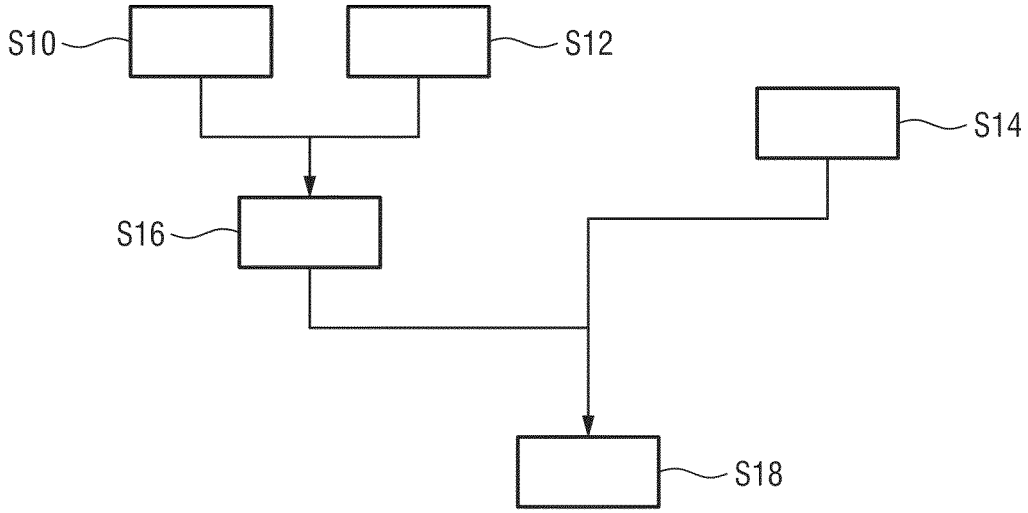
FIG. 14 shows a simplified block diagram of an exemplary embodiment of a method of manufacturing a stationary blade for a blade set.

Further reference is made to FIG. 14 which is a block diagram illustrating several steps of an exemplary embodiment of a method of manufacturing stationary blade for a blade set of a hair cutting appliance.

The method involves a step S10 which involves a provision of a plurality of tooth components. Preferably, the tooth components are obtained from metal material, particularly from sheet metal material. Hence, a thickness of the metal material defines of thickness of the tooth components which is reflected a resulting thickness of the teeth of the stationary blade. As the tooth components may be obtained from flat metal material, the shape thereof may involve a considerably large tapering.

A further, optional step S12 may be present which involves a provision of tooth spacers. Also the tooth spacers may be obtained from metal material, particularly from sheet metal material. Hence, the number of tooth spacers basically corresponds to the number of tooth components.

In another step S14, a blade base is provided. The blade base is arranged to receive and support the plurality of tooth components and, if any, tooth spacers. In an exemplary embodiment, the blade base is made from a metal material, particularly from aluminum or an aluminum containing alloy. Generally, the blade base may be obtained by a die casting process. The blade base is not provided with cutting edges which are provided by the additional tooth components. Hence, the blade base may be formed from a less-costly or a lower-quality material.

In a further optional step S16, the tooth components and the tooth spacers are arranged to form a series of tooth components and tooth spacers in an alternating order. This may involve a mounting procedure, for instance a mutual engagement of neighboring parts through material displacement. Further, the step S16 may involve a bonding operation including laser bonding, soldering, etc. The step S16 may involve an interconnection of the involved tooth components and, if any, tooth spacers. The step S16 may result in the provision of an intermediate stack that defines a toothing of the stationary blade.

A further step S18 may involve an attachment of the stack obtained in the step S16 to the blade base provided in the step S14. The step S18 may involve one of a bonding operation, a snap-on locking-operation, a molding operation, and combinations thereof. The bonding operation may involve laser bonding, soldering, ultrasonic welding, friction welding, etc. The snap-on locking-operation may involve an engagement of snap-on or click-in mounting features. The molding operation may involve an insert molding and an overmolding operation.

Figure 15:
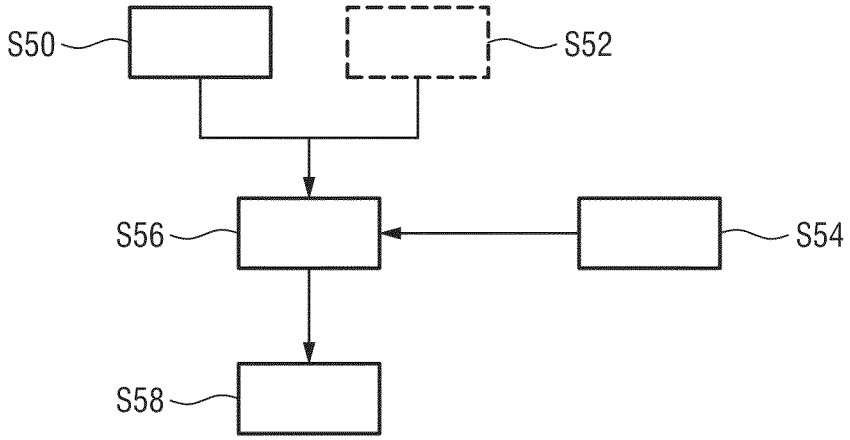
FIG. 15 shows a simplified block diagram of another exemplary embodiment of a method of manufacturing a stationary blade for a blade set.

With reference to the block diagram shown in FIG. 15, several steps of an alternative exemplary embodiment of a method of manufacturing stationary blade for a blade set of a hair cutting appliance will be explained.

The method involves a step S50 which basically corresponded to the step S10 discusses further above in connection with FIG. 14. The step S50 relates to the provision of tooth components. Further, an optional step S52 may be provided which corresponds to the step S12 discussed above and involves the provision of tooth spacers.

Further, a step S54 is provided which involve the provision of a mold for injection molding. The mold may be arranged as an overmolding and/or an insert molding mold. The mold is arranged to receive the tooth components provided in the step S50 and, if any, the tooth spacers provided in the step S52. Further, the mold may define a shape of a blade base which receives and supports the tooth components. In some embodiments, the step S52 may also involve the provision of a base frame for a blade base in the mold. The base frame may be arranged as a metal frame for injection molding and/or overmolding.

Consequently, a step S56 is provided which involves an arrangement of the tooth components and, if any, the tooth spacers in the mold. The tooth components may be arranged to form a series of tooth components including teeth spaced apart from one another at a defined offset.

In a subsequent step S58, an injection moldable plastic material is inserted into the mold. Hence, an overmolding or insert molding procedure may be accomplished. As a result, the blade base is formed in, at the same time, the tooth components are fixedly attached thereto.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair cutting appliance comprising a housing, a cutting head comprising a blade set comprising a stationary blade and a cutter blade, wherein the stationary blade and the cutter blade are arranged to be moved with respect to each other to cut hair, the stationary blade comprising:

a blade base arranged as a supporting receptacle and having slots which define an adjustment movement range of the stationary blade;

a plurality of teeth fixedly attached to the blade base; and a cutting length adjustment mechanism arranged to set a relative position between the plurality of teeth of the stationary blade and teeth of the cutter blade so as to define a cutting length by causing movement of the stationary blade within the slots, wherein respective teeth of the plurality of teeth of the stationary blade are formed by separate tooth components obtained from metal material, wherein the tooth components are arranged to form a series of tooth components, wherein neighboring tooth components are arranged at a distance from one another defining gaps between the neighboring tooth components, and wherein the tooth components are partially tapered towards a tip end thereof.

2. The hair cutting appliance as claimed in claim 1, wherein the tooth components are stacked, and wherein the gaps between the neighboring tooth components are defined by tooth spacers obtained from the metal material.

3. The hair cutting appliance of claim 1, wherein the blade base is formed from plastic material, wherein the tooth components are stacked, and wherein the gaps between the neighboring tooth components are defined by the plastic material that fills at least a portion of the gaps and defines tooth spacers.

4. The hair cutting appliance of claim 1, further comprising spacers between the tooth components, wherein a height of a tooth component of the tooth components is larger than a height of a spacer of the spacers, and wherein a width of the tooth component is different from the width of the spacer.

5. The hair cutting appliance of claim 1, wherein the plurality of teeth includes a first type of tooth components and a second type of tooth components, and wherein the first type tooth components have greater heights than the second type of tooth components.

6. The hair cutting appliance of claim 1, wherein a thickness of the metal material defines a thickness of the plurality of teeth of the stationary blade.

7. The hair cutting appliance of claim 1, wherein the blade base has a mounting protrusion and the tooth components have recesses that form a mounting recess configured to mate with the mounting protrusion of the blade base.

8. A method of forming a stationary blade for a hair cutting appliance, the method comprising acts of:

providing tooth components obtained from metal material, the tooth components being partially tapered towards a tip end thereof;

arranging the tooth components to form a series of tooth components, wherein neighboring tooth components are arranged at a distance from one another;

providing a blade base arranged as a supporting receptacle and having slots which define an adjustment movement range of the stationary blade, the blade base being arranged to receive the tooth components; and interconnecting the tooth components and the blade base thereby forming teeth of the stationary blade.

9. The method as claimed in claim 8, wherein the interconnecting act comprises acts of stacking the tooth components, thereby forming an intermediate stack; and attaching the intermediate stack to the blade base.

10. The method as claimed in claim 8, wherein the act of providing the tooth components comprises acts of:

providing tooth components at an intermediate manufacturing stage that are obtained from sheet metal material, wherein a thickness of the sheet metal material defines a thickness of the teeth of the stationary blade, and processing the tooth components involving forming cutting edges thereon.

11. The method as claimed in claim 8, wherein the blade base is made from metal material including aluminum or an aluminum containing alloy.

12. The method as claimed in claim 8, wherein the interconnecting act includes overmolding or insert molding the tooth components with a plastic component.

13. The method as claimed in claim 12, wherein the plastic component at least partially fills a gap between neighboring tooth components and bonds the tooth components to the blade base.

14. The method as claimed in claim 12, wherein the plastic component forms the blade base, wherein the stationary blade is a metal plastic composite blade.

15. The method of claim 8, wherein the act of providing the blade base includes an act of forming a mounting protrusion on the blade base, and wherein the act of providing the tooth components includes forming a recess in each of the tooth components to form a mounting recess configured to mate with the mounting protrusion of the blade base.

16. A method of forming a stationary blade for a hair cutting appliance, the method comprising acts of:

providing tooth components obtained from metal material, the tooth components being partially tapered towards a tip end thereof;

arranging the tooth components to form a series of tooth components, wherein neighboring tooth components are arranged at a distance from one another;

providing a blade base arranged as a supporting receptacle, the blade base arranged to receive the tooth components;

interconnecting the tooth components and the blade base in a direct or mediate fashion, thereby forming teeth of the stationary blade;

providing tooth spacers; and forming an intermediate stack at least sectionally comprising the tooth components alternating with the tooth spacers, the tooth components and the tooth spacers being arranged as layers in the intermediate stack.

17. The method as claimed in claim 16, wherein the tooth spacers and the tooth components, at a rear end of the intermediate stack, define a mating contour for attaching the stack to the blade base.

18. The method as claimed in claim 16, wherein the tooth spacers are made from at least one of metal material, plastic material, and combinations thereof.

19. The method as claimed in claim 16, wherein the tooth spacers are obtained from sheet metal material, wherein a thickness of the sheet metal material defines a gap between the teeth of the stationary blade, and the act of providing the tooth spacers includes obtaining the tooth spacers from a sheet metal blank by cutting.

20. The method as claimed in claim 16, wherein the forming act includes forming the intermediate stack into an interlocked stack, and wherein at least some of the layers engage their neighboring layers in the stack.

* * * * *